United States Patent [19]

Jung

[11] 4,377,008

[45] Mar. 22, 1983

[54] ARTICLE OF CLOTHING

[75] Inventor: Jung D. Jung, Glendale, Calif.

[73] Assignees: Chicksu Thomas Yi, Rolling Hills; Helen Yuki Jung, Glendale, both of Calif.

[21] Appl. No.: 163,388

[22] Filed: Jun. 26, 1980

[51] Int. Cl.[3] ..... A41B 9/02

[52] U.S. Cl. ..... 2/403; 128/159

[58] Field of Search ..... 2/403, 404, 405, 402, 2/400; 128/159, 158

[56] References Cited

U.S. PATENT DOCUMENTS

| | | | |
|---|---|---|---|
| 2,601,602 | 6/1952 | Firsching, Sr. | 2/403 X |
| 3,207,155 | 9/1965 | Casey | 2/403 X |
| 3,459,181 | 8/1969 | Mann | 128/159 |
| 3,621,846 | 11/1971 | Lehman | 2/403 X |
| 4,195,630 | 4/1980 | Connery et al. | 2/403 X |

FOREIGN PATENT DOCUMENTS

| | | | |
|---|---|---|---|
| 190014 | 5/1957 | Austria | 2/403 |
| 280164 | 4/1952 | Switzerland | 2/405 |
| 459968 | 1/1937 | United Kingdom | 2/405 |

*Primary Examiner*—H. Hampton Hunter

*Attorney, Agent, or Firm*—Arthur V. Doble

[57] ABSTRACT

An improved article of clothing, more particularly an undergarment, mainly for use in the form of men's briefs or shorts. This invention serves as a health aid and includes the use of a separate compartment in the undergarment which permits the scrotum of the male wearer to be kept from making direct contact with other nearby parts of the body, and to keep the penis in an upward position, away from the scrotum while this undergarment is being worn.

An elastic band biases the front base opening of the undergarment toward its closed position, while the scrotum of the wearer is positioned outside of the front base opening, with the elastic band tending to prevent the scrotum from falling back inside the front opening of the garment. A second elastic band is located in the upper area of the front base opening of the garment through which the penis is placed and kept apart from the scrotum. An outer-cover member is placed over the front base opening of the undergarment to form the aforementioned compartment and to cover the male members for conventional purposes of warmth, protection and modesty.

7 Claims, 4 Drawing Figures

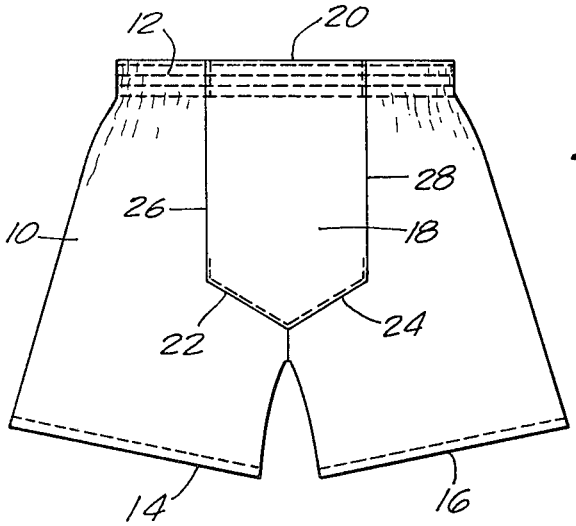
FIG. 1.
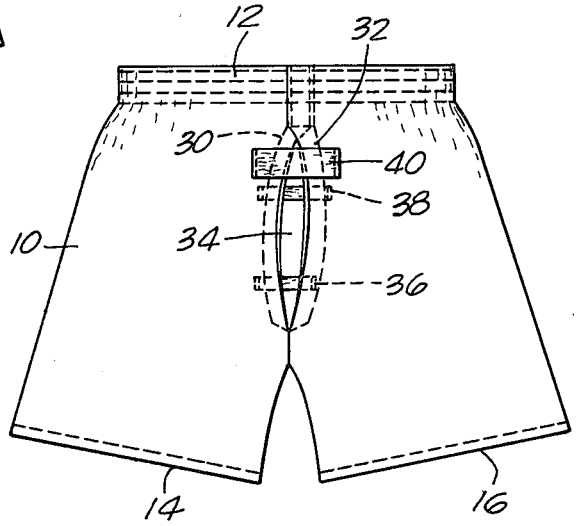
FIG. 2.
FIG. 3.
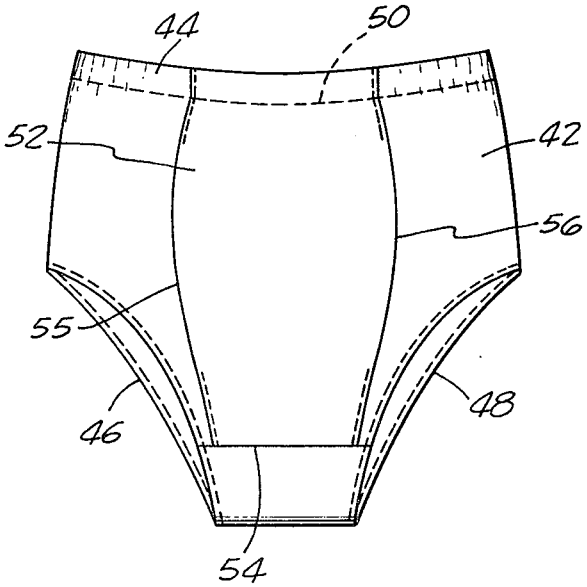
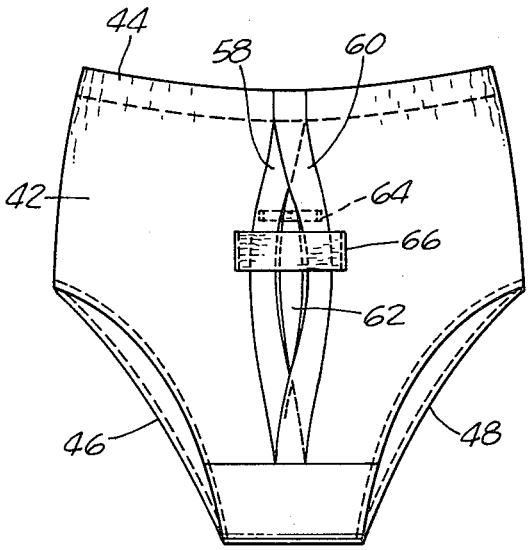
FIG. 4.

ARTICLE OF CLOTHING

BACKGROUND OF THE INVENTION

1. Field of the Invention

This invention generally relates to an article of clothing, and more particularly to an improved undergarment of the men's briefs or shorts variety.

2. Description of the Prior Art

The development of undergarments for wearing by men and women has evolved over a period of many years. The use of multi-layering of clothing is, perhaps, as old of a practice as the wearing of clothing itself.

Historically, it has become apparent that a person can obtain many benefits from the wearing of undergarments. These benefits generally include factors of body comfort and protection from abrasion. The comfort lies in the softness of the materials placed next to the skin, and oftentimes includes physical support. The use of these additional materials also provide warmth in cold weather, and they are perspiration-absorbing in warm weather.

For the purpose of covering the lower portion of the male torso, the ordinary "briefs" or "under-shorts" are the most common undergarments worn by men today. These male undergarments have for many years, done an adequate job in satisfying the foregoing intended purposes as articles of clothing. However, none of the male undergarments known in the prior art have provisions for separating the scrotum from the penis and other adjacent parts of the male body while yet fully covering these members.

Accordingly, the many additional benefits to health and comfort which could be obtained through the use of applicant's invention have heretofore never been realized through the use of prior conventional male undergarments. In fact, present male undergarments tend to keep the temperature of the scrotum too high and thus induces perspiration thereof, which is nature's way for providing cooling of a member of the body. Existing undergarments also tend to keep the scrotum in abrasive contact with the penis and other parts of the body.

From a medical textbook entitled "A Companion to Medical Studies", Volume I, by R. Passmore and J. S. Robson, published in 1968, we learn that the temperature of the scrotal testes in man is 1.5° to 2.5° C. lower than the temperature of the abdominal cavity, and that the testes appear to function optimally at this lower temperature. These authors state that even a slight elevation in temperature produces a transient impairment in sperm production.

In the fifth edition of "Textbook of Medical Physiology", by Arthur C. Guyton, M.D., published in 1976 by W. B. Saunders Company, it is confirmed that increased temperatures directly shorten the life of sperm. We also learn that spermatogenesis, which simply means the formation of sperm, may actually be prevented by the increased temperatures through cell degeneration. Dr. Guyton explains that the testicles are located in the dangling scrotum in order to maintain the temperature of these glands below the temperature of the body; that on cold days reflexes cause the scrotal muscles to contract, bringing the testicles close to the body; and, that on warm days the scrotum becomes relaxed so that the testicles normally hang far from the body. In his test, Dr. Guyton further states that the scrotum is designed to act as a cooling mechanism for the testicles, without which spermatogenesis is deficient.

With the use of existing undergarments the freedom of scrotal movement is impaired and improper temperatures may be experienced by their wearers of those prior art undergarments.

SUMMARY OF THE INVENTION

Applicant herein has conceived of a new and useful improved article of clothing, or undergarment. Said article of clothing is principally intended for use as a new type of men's undergarment, i.e. briefs, shorts, or the like item of clothing.

Applicant's invention incorporates the use of a scrotum-retaining means, which in this embodiment is a compartment in a male undergarment for retention of the scrotum.

The penis is kept away from the scrotum through the use of a penis-retaining means, which in this embodiment is an elastic band. This separation of the scrotum from the body aids the scrotum in retaining its natural, lower temperature.

Applicant's undergarment, in some respects, looks similar to conventional men's briefs or shorts. However, in applicant's undergarment, a separate compartment for scrotum location is formed by the addition of an outer-cover member being placed over the front base opening of the undergarment.

One embodiment of this undergarment utilizes an elastic band located across and inside of, the lower portion of the front base opening to keep that opening in a closed position and to prevent the scrotum from falling back inside the front opening of the undergarment when being worn.

Another elastic band is located across, and outside of, the front base opening of the undergarment, to retain the penis in a location which is away from any contact with the scrotum. Other elastic bands or fasteners can be added at other convenient locations to keep the front base opening closed, without limiting or changing the scope or intention of the present invention.

The present invention shows several features of novelty over the known prior art, including the capability of keeping the location of the scrotum separated from the penis and other parts of the body to prevent the temperature of the scrotum from being increased by the heat from adjacent body parts.

It is therefore an object of this invention to provide an improved article of clothing of the men's undergarment type having a separate compartment for the scrotum and penis to aid in preventing the scrotum from contacting adjacent body parts and elevating its temperature.

It is another object of the invention to provide an improved article of clothing of the men's undergarment type which has a separate compartment for the scrotum and penis formed by the use of a simple layer of cloth being placed over the front base opening of men's briefs.

It is another object of this invention to provide an improved article of clothing of the men's undergarment type having an elastic band within the above separate compartment to separate the scrotum and the penis of the wearer.

It is another object of this invention to provide an improved article of clothing of the men's undergarment type having an elastic band located inside the front base opening to the garment for biasing this front opening toward its closed position, the elastic band further serving to retain the scrotum in a position outside of the regular front opening.

It is still a further object of this invention to provide an improved article of clothing which serves as a health aid by enhancing hormone production and spermatogenesis, as well as to improve the physical mood and productivity of the wearer of the garment.

For a better understanding of this present invention, together with other and further objects thereof, reference is made to the following description taken in connection with the accompanying drawings in which preferred embodiments of this invention are illustrated, the scope of the invention being pointed out and contained in the appended claims.

BRIEF DESCRIPTION OF THE DRAWINGS

FIG. 1 is a front view of one embodiment of the improved article of clothing, showing an outer cover member which is placed over the front base opening of the garment.

FIG. 2 is a front view of the same embodiment of the improved article of clothing showing details of its's construction with the outer cover member removed for purposes of clarity.

FIG. 3 is a front view of another embodiment of the improved article of clothing (shorts), showing an outer cover member which is placed over the front base opening of the garment.

FIG. 4 is a front view of this same latter embodiment of the improved article of clothing showing details of its construction with the outer-cover member removed for purposes of clarity.

DESCRIPTION OF THE PREFERRED EMBODIMENTS

In FIG. 1 there is shown at 10 a preferred embodiment of this improved article of clothing, or undergarment. An elastic waist-band 12 is typically used to hold this type of undergarment on the wearer's body. The right leg of the wearer will pass thru the right-leg section 14 of undergarment 10, and the left leg of the wearer will pass through the left-leg section 16 of undergarment 10. The upper end 20 of outer-cover member 18 is attached to front of the undergarment 10 at the waist-band 12. Lower edges 22 and 24 of the outer-cover member 18 are attached to undergarment 10 near the right-leg section 14 and left-leg section 16, respectively. Inner access to the wearer's body parts is facilitated through openings located at edges 26 and 28 of the outer-cover member 18.

In FIG. 2, the outer-cover member 18 shown in FIG. 1, is removed to demonstrate the remaining construction of the front portion of undergarment 10. Seamed edges 30 and 32 define the front opening 34 of undergarment 10, and in this figure a nominal amount of opening is shown. The scrotum of the wearer is placed through said opening 34 and lies over the outside of the lower portion of edges 30 and 32. An elastic band 36 is located on the inside of undergarment 10 as shown and is attached to it at each of its ends near the lower portion of edges 30 and 32. This elastic band 36 serves several purposes which include the biasing of opening 34 to it's closed position, and to act as a means for retaining the scrotum outside undergarment 10 through it's opening 34. An additional elastic band may be placed across opening 34 of undergarment 10, as shown by band 38, at any convenient vertical location near the penis with the ends of each such band being attached near edges 30 and 32. Elastic band 38 serves as a means for biasing the front opening of the undergarment to it's closed position adjacent to the penis.

A slightly larger elastic band 40 is located across the outside of edges 30 and 32 of undergarment 10 with the ends of band 40 being attached to opposite sides of opening 34. The inner elastic bands 36 and 38 will keep the opening 34 snugly closed around the base of the scrotum and penis of the wearer of this undergarment 10, as the scrotum is positioned outside of opening 34 and the penis is retained in an upward position by elastic band 40. As previously stated, the outer-cover member 18 then conceals the genitalia which would otherwise be exposed as they protrude through opening 34.

In FIG. 3, there is shown at 42 another embodiment of applicant's invention in an undergarment in the form of men's briefs. In this type of undergarment, an elastic waist band 44 is used to keep the garment on the wearer's body. The right leg of the wearer passes through the right-leg section 46 of the undergarment 42, and the left leg of the wearer will pass through the left-leg section 48 of the undergarment 42. The upper end 50 of the outer-cover member 52 is attached to the front of the undergarment 42 at the waist band 44, and the lower end 54 of outer-cover member 52 is attached to the bottom front side of the undergarment 42. Inner access to the wearer's body parts is facilitated through openings located at edges 55 and 56 of outer-cover member 52.

In FIG. 4, the outer-cover member 52, shown in FIG. 3, is removed to demonstrate the remaining construction of the front portion of undergarment 42. Seamed edges 58 and 60 define the front base opening 62 of undergarment 42, and in this FIG. 4 a nominal amount of opening is shown. The scrotum is placed through opening 62 and lies over the outside surfaces of the undergarment 42 in the lower vicinity of seamed-edges 58 and 60. An elastic band 64 is located on the inside of undergarment 42 as shown and is attached to undergarment 42 at each of its ends at any vertical location convenient to the manufacture, for the purpose of biasing the opening 62 to it's closed position.

A slightly larger elastic band 66 is located across the outside of edges 58 and 60 of undergarment 42 with the ends of band 66 being attached to opposing sides of opening 62. The inner elastic band 64 will keep the opening 62 snugly closed around the base of the scrotum and penis, as the scrotum is positioned outside of opening 62 and the penis is retained in an upward position by the elastic band 66. The outer-cover member 52 then conceals the genitalia which would otherwise be exposed as they protrude through opening 62.

Having now described the invention in detail in accordance with the requirements of the patent statutes, those skilled in the art will have no difficulty in making changes and modifications in the individual parts or their relative assembly in order to meet specific requirements or conditions. Such changes and modifications may be made without departing from the scope and spirit of the invention, as set forth in the following claims.

I claim:

1. In a male undergarment to be worn over the lower torso, said undergarment having a base opening in the front thereof for access to the genitalia, an improvement in said undergarment, said improvement comprising, in combination:

(a) Scrotum-retaining means for separating the scrotum of the wearer of the undergarment from direct contact with other parts of the wearer's body;

(b) penis-retaining means associated with said scrotum-retaining means for separating the penis of the wearer of the undergarment from direct contact with the scrotum, whereby the scrotum is kept at a reduced temperature for enhancement of hormone and sperm production, said scrotum-retaining means comprising:

(c) An outer-cover member attached to the undergarment and covering the front base opening of the undergarment for providing a separate scrotum-retaining compartment between said outer-cover member and the front of said undergarment for separating the scrotum from direct contact with other parts of the wearer's body; and (d) means for biasing the base opening in the front of the undergarment toward it's closed position next to the base of the scrotum which passes through said opening while the undergarment is being worn, to retain the scrotum within said separate compartment, and (e) means for biasing the base front opening of the undergarment toward it's closed position adjacent to the base of the penis which passes through said opening, while the undergarment is being worn, to aid in retaining the penis in the upper portion of said scrotum-retaining compartment.

2. The improvement in the male undergarment of claim 1, above, wherein the outer-cover member is attached at it's upper and lower ends to the upper and lower portions, respectively, of the front side of said undergarment, the sides of said outer-cover member being unattached to said undergarment to permit access to body parts of the wearer of the undergarment.

3. The improvement in the male undergarment of claim 1, above, wherein the means for biasing the front base opening of the undergarment toward its closed position adjacent to the base of the scrotum comprises an elastic member attached at it's ends to opposing sides of the front base opening of said undergarment.

4. The improvement in the male undergarment of claim 1, above, wherein the penis-retaining means comprises a penis-retaining member attached to the undergarment across the outer side of the front base opening for supporting and retaining the penis in an upward position against the front of the undergarment and away from contact with the scrotum.

5. The improvement in the male undergarment of claim 4, above, wherein the penis-retaining member comprises an elastic band.

6. The improvement in the male undergarment of claim 4, above, wherein the penis-retaining member comprises an elasticized cloth band.

7. In a male undergarment to be worn over the lower torso, said undergarment having a base opening in the front thereof for access to the genitalia, an improvement in said undergarment, said improvement comprising, in combination:

(a) scrotum-retaining means for separating the scrotum of the wearer of the undergarment from direct contact with other parts of the body, said scrotum-retaining means including an outer-cover member attached to said undergarment covering it's front base opening for providing a separate scrotum-retaining compartment between said outer-cover member and the front of said undergarment to facilitate placement of the scrotum in a location separate from direct contact with other parts of the wearer's body, said scrotum-retaining means further including an elastic member attached at it's ends to opposing sides of the front base opening of the undergarment for biasing said opening towards it's closed portion adjacent to the base of the scrotum;

(b) penis-retaining means associated with said scrotum-retaining means for separating the penis of the wearer of the undergarment from direct contact with the scrotum, the penis-retaining means having an elastic member attached at it's ends across the outer side of the front base opening of the undergarment for supporting and retaining the penis in an upward position away from the scrotum; and (c) means for biasing the front base opening of the undergarment toward it's closed position adjacent to the base of the penis, which passes through said opening while the undergarment is being worn, to aid in retaining the penis in the upper portion of said scrotum-retaining compartment, whereby the scrotum is kept at a reduced temperature for enhancement of hormone and sperm production.

* * * * *